US005844375A

United States Patent [19]

Lin et al.

[11] Patent Number: 5,844,375

[45] Date of Patent: Dec. 1, 1998

[54] DUAL-INVERTER TYPE OPERATING CIRCUIT FOR GENERATING TWO AC SIGNALS THAT ARE RESPECTIVELY PROVIDED TO TWO LAMP ELECTRODES OF A GAS DISCHARGE LAMP

[75] Inventors: Tung-Hsin Lin; Chin-Lu Peng, both of Hsin-Chu, Taiwan

[73] Assignee: Taiwan Chi Yi Lighting Industrial Co., Ltd., Hsin-Chu, Taiwan

[21] Appl. No.: 760,471

[22] Filed: Dec. 5, 1996

[51] Int. Cl.[6] ..... H05B 37/00

[52] U.S. Cl. ..... 315/209 R; 315/200 R; 315/219; 315/224

[58] Field of Search ..... 315/209 R, 213, 315/214, 215, 216, 227 R, 228, 200 R, 201, 205, 206, DIG. 5, 219, 224

[56] References Cited

U.S. PATENT DOCUMENTS 5,489,823 2/1996 Nilssen ..... 315/227 R

*Primary Examiner*—Robert J. Pascal
*Assistant Examiner*—David H. Vu
*Attorney, Agent, or Firm*—Sheridan Ross P.C.

[57] ABSTRACT

An operating circuit for a gas discharge lamp includes a rectifier to be connected to an AC power line for generating positive and negative DC voltages, a first inverter connected to the rectifier for converting the DC voltages into a first substantially square wave AC signal, a series resonator for connecting the first inverter with a first lamp electrode, and a second inverter connected to the rectifier for converting the DC voltages into a second substantially square wave AC signal. The second inverter is to be connected to a second lamp electrode. The first and second substantially square wave AC signals have substantially equal fundamental frequencies and are out of phase.

5 Claims, 6 Drawing Sheets

DUAL-INVERTER TYPE OPERATING CIRCUIT FOR GENERATING TWO AC SIGNALS THAT ARE RESPECTIVELY PROVIDED TO TWO LAMP ELECTRODES OF A GAS DISCHARGE LAMP

BACKGROUND OF THE INVENTION

1. Field of the Invention

The invention relates to an operating circuit for a gas discharge lamp, more particularly to a dual-inverter type operating circuit for a gas discharge lamp.

2. Description of the Related Art

It is known that slow starting of a gas discharge lamp, such as a fluorescent lamp, can cause flickering of the lamp and adversely affect the service life of the same. Some conventional operating circuits for gas discharge lamps operate the lamps at higher frequencies for higher-efficacy lamp operation, thereby prolonging the service life of the lamps. However, increasing the operating frequency usually results in higher component costs. Other conventional operating circuits operate the lamps at higher voltages for higher-efficacy lamp operation. Increasing the operating voltage, however, results in greater power consumption and in higher operating costs.

SUMMARY OF THE INVENTION

Therefore, the object of the present invention is to provide a cost-effective operating circuit which permits quick starting of a gas discharge lamp to prolong the service life of the same.

Accordingly, the operating circuit of the present invention is to be applied to a gas discharge lamp with first and second lamp electrodes, and includes:

- rectifier means adapted to be connected to an AC power line for generating positive and negative DC voltages;
- first inverter means connected to the rectifier means for converting the DC voltages into a first substantially square wave AC signal;
- series resonance means adapted to connect the first inverter means with the first lamp electrode; and
- second inverter means connected to the rectifier means for converting the DC voltages into a second substantially square wave AC signal, the second inverter means being adapted to be connected to the second lamp electrode, the first and second substantially square wave AC signals having substantially equal fundamental frequencies and being out of phase.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
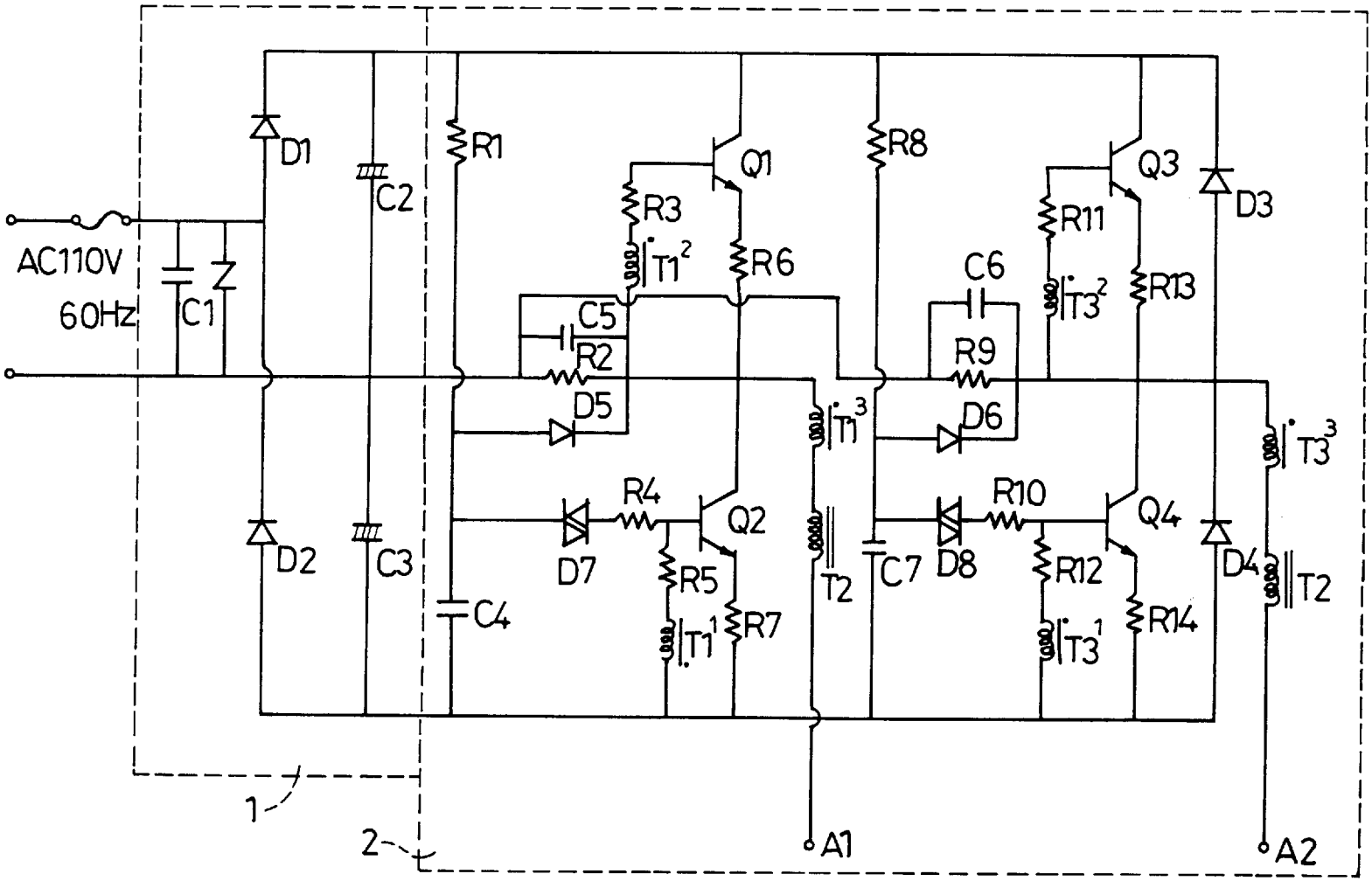
FIG. 1 is a schematic electrical circuit diagram of the preferred embodiment of an operating circuit for a gas discharge lamp according to the present invention.
Figure 2:
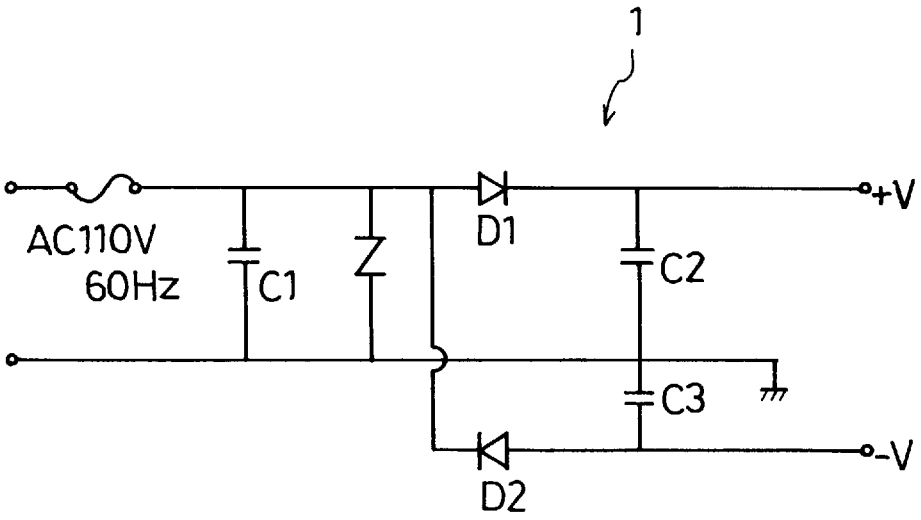
FIG. 2 is a schematic electrical circuit diagram of a rectifier circuit of the preferred embodiment.
Figure 3:
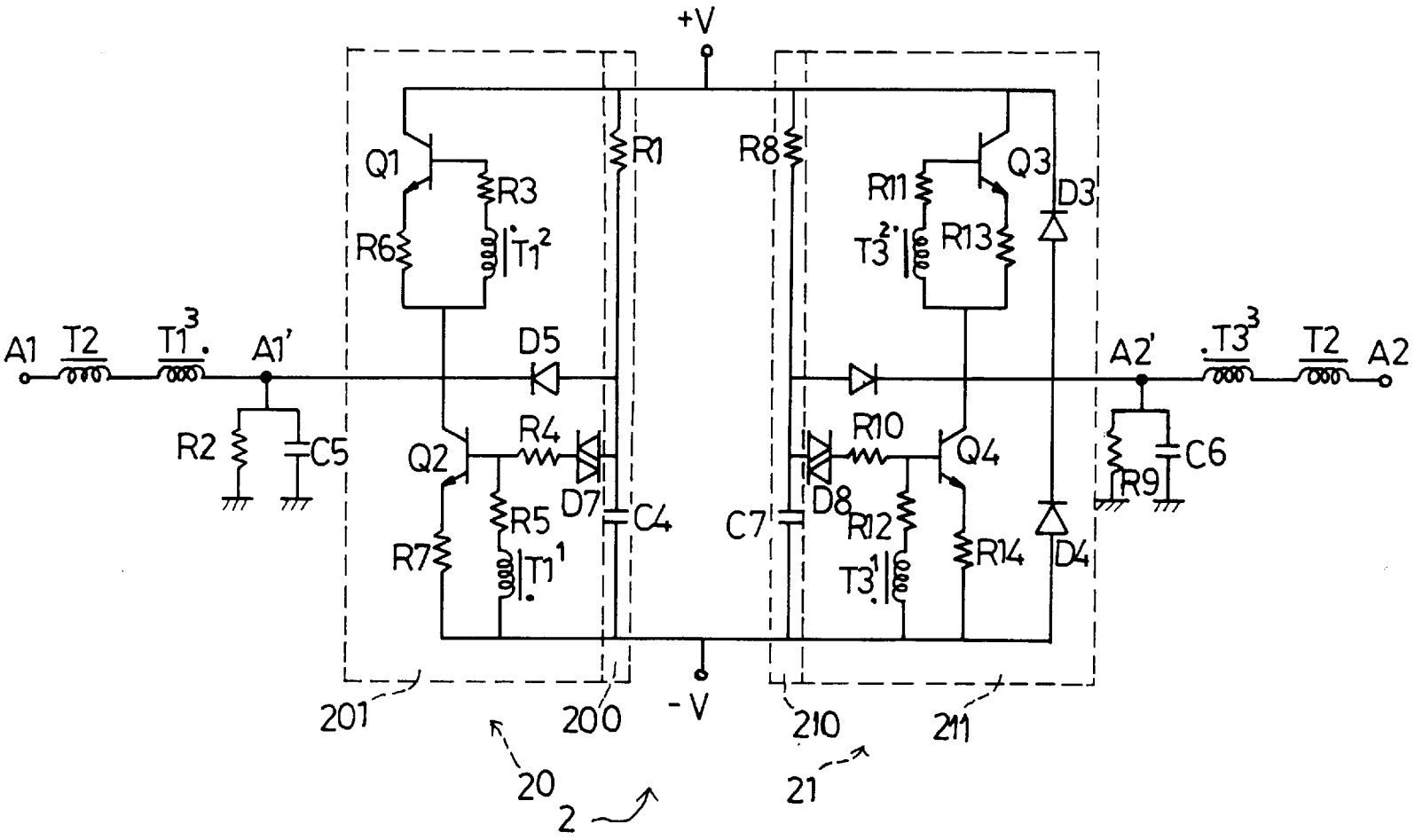
FIG. 3 is a schematic electrical circuit diagram of an inverter device of the preferred embodiment.

Referring to FIG. 1, the preferred embodiment of an operating circuit for a gas discharge lamp, such as a fluorescent lamp, is shown to comprise a rectifier circuit 1 and an inverter device 2. In FIGS. 2 and 3, the rectifier circuit 1 and the inverter device 2 are redrawn for the sake of clarity. As shown in FIG. 2, the rectifier circuit 1 is a conventional circuit which is to be connected to an AC 110 volt, 60 Hz power line and which generates positive and negative DC voltages +V, −V for the inverter device 2.

Figure 4:
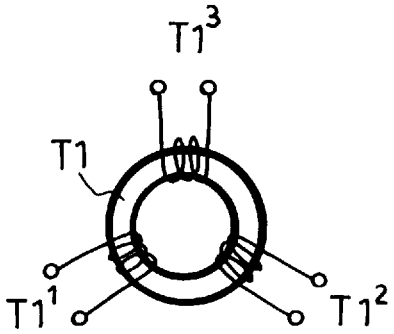
FIG. 4 illustrates how a first set of polarized windings of the inverter device are coupled.
Figure 5:
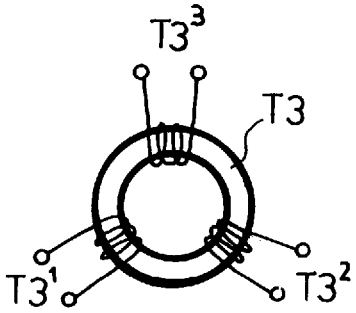
FIG. 5 illustrates how a second set of polarized windings of the inverter device are coupled.

Referring to FIG. 3, the inverter device 2 includes first and second inverter circuits 20, 21. The polarized windings $T1^1$, $T1^2$, $T1^3$ of the first inverter circuit 20 are coupled magnetically via a toroidal core T1, as shown in FIG. 4. The polarized windings $T3^1$, $T3^2$, $T3^3$ of the second inverter circuit 21 are coupled magnetically via a toroidal core T3, as shown in FIG. 5.

The first inverter circuit 20 comprises a half-bridge transistor circuit 201 and a firing circuit which includes a charge-discharge circuit 200 and a trigger element D7.

The charge-discharge circuit 200 includes a resistor R1 and a capacitor C4 connected in series with the resistor R1. The charge-discharge circuit 200 is connected across the rectifier circuit 1, as shown in FIGS. 1 and 2, and receives the DC voltages +V, −V therefrom. The trigger element D7 is a diac which interconnects the transistor circuit 201 and the charge-discharge circuit 200.

Figure 6:
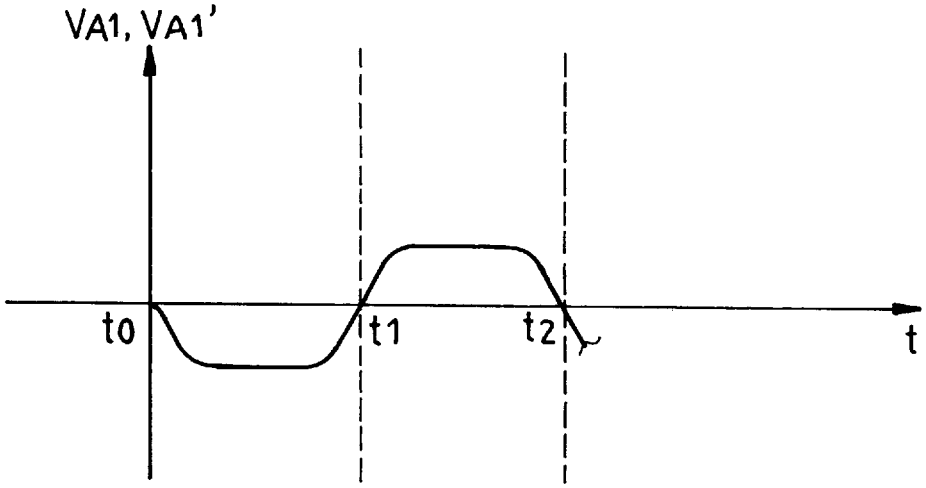
FIG. 6 illustrates a substantially square wave AC signal that is obtained from a first inverter circuit of the inverter device.

In operation, the charge-discharge circuit 200 is charged by the DC voltages +V, −V from the rectifier circuit 1. When the voltage across the capacitor C4 reaches the breakdown voltage of the trigger element D7, the trigger element D7 conducts, and the capacitor C4 discharges via the trigger element D7, the resistors R4, R5, and the polarized winding $T1^1$. The transistor Q2 of the transistor circuit 201 conducts at this time. The transistor Q1 of the transistor circuit 201 does not conduct since the polarity of the polarized winding $T1^2$ is opposite to that of the polarized winding $T1^1$. When the discharge current from the capacitor C4 drops below the holding current of the trigger element D7, the trigger element D7 ceases to conduct. At the same time, by virtue of Lenz's law, the polarized winding $T1^1$ generates a reverse bias voltage which turns off the transistor Q2 while the polarized winding $T1^2$ causes the transistor Q1 to conduct. FIG. 6 illustrates the voltages VA1, VA1' at nodes A1, A1' of the first inverter circuit 20. The voltages VA1, VA1' are in the form of a high frequency, substantially square wave AC signal. The time period from t0 to t1 corresponds to the time period when the transistor Q2 conducts while the transistor Q1 is cut-off, while the time period from t1 to t2 corresponds to the time period when the transistor Q1 conducts while the transistor Q2 is cut-off.

Referring again to FIG. 3, the second inverter circuit 21 is similar to the first inverter circuit 20 and also comprises a half-bridge transistor circuit 211 and a firing circuit which includes a charge-discharge circuit 210 and a trigger element D8.

The charge-discharge circuit 210 includes a resistor R8 and a capacitor C7 connected in series with the resistor R8. The charge-discharge circuit 210 is connected across the rectifier circuit 1, as shown in FIGS. 1 and 2, and receives the DC voltages +V, −V therefrom. The trigger element D8 is a diac which interconnects the transistor circuit 211 and the charge-discharge circuit 210.

Figure 7:
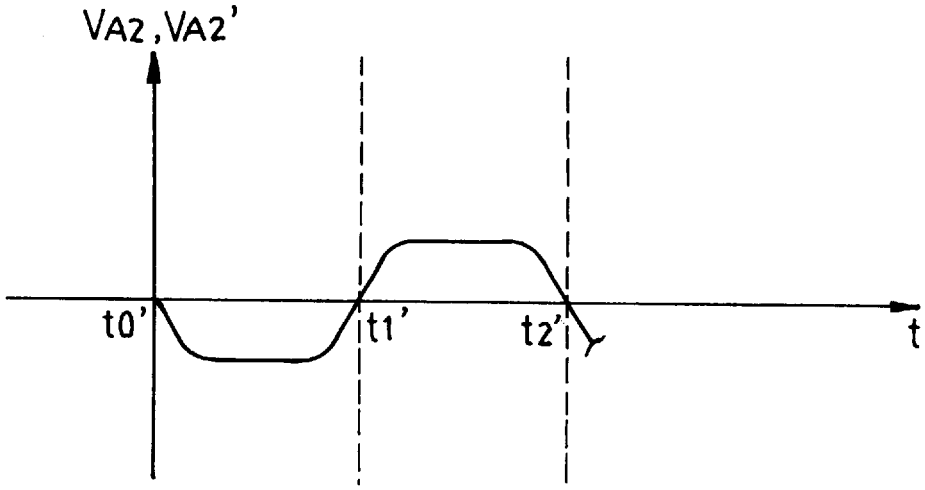
FIG. 7 illustrates a substantially square wave AC signal that is obtained from a second inverter circuit of the inverter device.

In operation, the charge-discharge circuit 210 is charged by the DC voltages +V, −V from the rectifier circuit 1. When the voltage across the capacitor C7 reaches the breakdown voltage of the trigger element D8, the trigger element D8 conducts, and the capacitor C7 discharges via the trigger element D8, the resistors R10, R12, and the polarized winding $T3^1$. The transistor Q4 of the transistor circuit 211 conducts at this time. The transistor Q3 of the transistor circuit 211 does not conduct since the polarity of the polarized winding $T3^2$ is opposite to that of the polarized winding $T3^1$. When the discharge current from the capacitor C7 drops below the holding current of the trigger element D8, the trigger element D8 ceases to conduct. At the same time, by virtue of Lenz's law, the polarized winding $T3^1$ generates a reverse bias voltage which turns off the transistor Q4 while the polarized winding $T3^2$ causes the transistor Q3 to conduct. FIG. 7 illustrates the voltages VA2, VA2' at nodes A2, A2' of the second inverter circuit 21. The voltages VA2, VA2' are in the form of a high frequency, substantially square wave AC signal. The time period from t0' to t1' corresponds to the time period when the transistor Q4 conducts while the transistor Q3 is cut-off, while the time period from t1' to t2' corresponds to the time period when the transistor Q3 conducts while the transistor Q4 is cut-off. It should be noted that the square wave AC signals from the first and second inverter circuits 20, 21 have substantially equal fundamental frequencies.

Figure 8:
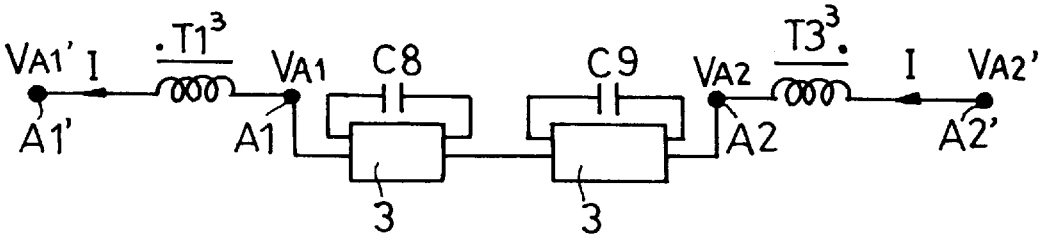
FIG. 8 illustrates how a pair of fluorescent lamps are connected in series with first and second series resonance circuits of the inverter device.

Referring to FIG. 8, the inverter device further comprises first and second series resonance circuits which connect the first and second inverter circuits 20, 21 to a pair of series connected fluorescent lamps 3. The first series resonance circuit includes the polarized winding $T1^3$ and a capacitor C8. The second series resonance circuit includes the polarized winding $T3^3$ and a capacitor C9. The first and second series resonance circuits convert the substantially square wave AC signals from the first and second inverter circuits 20, 21 into high amplitude, high frequency AC signals for driving the fluorescent lamps 3.

The first and second substantially square wave AC signals should be out of phase. Otherwise, if the conduction time t0 in FIG. 6 occurs at the same time as the conduction time t0' in FIG. 7, the fluorescent lamps 3 will not operate. In this embodiment, even if the second inverter circuit 21 is configured to be identical to the first inverter circuit 20, the trigger elements D7, D8 do not conduct at the same time. This is due to the slight differences between the actual component values and the rated component values of the inverter circuits 20, 21. Of course, the component values of the inverter circuits 20, 21 may be chosen so as to ensure that the square wave AC signals therefrom are out of phase. In this embodiment, the square wave AC signals are 180° out of phase.

Figure 9:
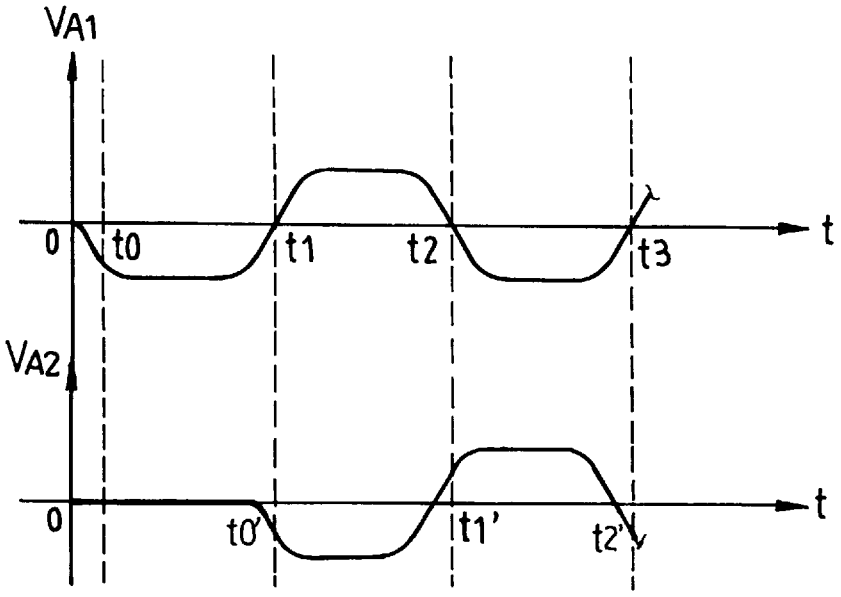
FIG. 9 is a timing diagram illustrating the relationship between the signals obtained from the first and second inverter circuits of the inverter device.

In the timing diagram of FIG. 9, it is assumed that the trigger element D7 conducts before the trigger element D8. The time period from 0 to t0 corresponds to an initial energizing period of the operating circuit, the time period from t0 to t1 corresponds to conduction of the trigger element D7, the time period from 0 to t0' corresponds to non-conduction of the trigger element D8, the time period from t1 to t2 corresponds to non-conduction of the trigger element D7, the time period from t0' to t1' corresponds to conduction of the trigger element D8, the time period from t2 to t3 corresponds to conduction of the trigger element D7, and the time period from t1' to t2' corresponds to non-conduction of the trigger element D8.

Referring again to FIGS. 3, 8 and 9, when the trigger element D7 conducts, the polarized winding $T1^1$ induces a current I (see FIG. 8) in the polarized winding $T1^3$, and causes current to flow through the polarized winding $T3^3$. A positive bias voltage is generated at the polarized winding $T3^1$ near the base terminal of the transistor Q4. The positive bias voltage has an effect of increasing the breakdown voltage of the trigger element D8 so that the transistor Q4 does not easily conduct. At the same time, the voltage across the polarized winding $T3^2$ causes saturation of the transistor Q3, and the saturation current through the transistor Q3 flows through the polarized winding $T3^3$, the fluorescent lamps 3, the polarized winding $T1^3$, and the transistor Q2.

As the discharge current through the trigger element D7 approaches the holding current, thereby eventually resulting in non-conduction of the trigger element D7, the polarized winding $T1^1$ turns off the transistor Q2. The transistor Q1 conducts, and the bias voltage across the polarized winding $T3^1$ is reduced, thereby causing the trigger element D8 to conduct. At this time, the transistor Q4 conducts, while the polarized winding $T3^2$ turns off the transistor Q3. Current to the fluorescent lamp 3 is supplied by the transistor Q1 and flows through the transistor Q4.

The trigger element D7 again conducts as the discharge current through the trigger element D8 approaches the holding current. As such, simultaneous operation of the first and second inverter circuits 20, 21 results in two high frequency, substantially square wave AC signals.

Referring again to FIG. 9, since the square wave AC signals of the first and second inverter circuits 20, 21 are approximately 180° out of phase in this embodiment, a higher operating voltage can be provided to the fluorescent lamps 3 without a substantial increase in the operating costs.

It should be noted that the number of series resonance circuits that are in use should correspond with the desired number of series connected fluorescent lamps to be operated by the operating circuit of this invention. In this embodiment, two series resonance circuits are employed since there are two fluorescent lamps 3. The series resonance circuits are both resonant at a suitable harmonic frequency component of the square wave AC signals from the first and second inverter circuits 20, 21.

Only one of the series resonance circuits is required if only one fluorescent lamp 3 is to be operated by the operating circuit of the present invention. As such, the resonant frequency of the sole series resonance circuit is chosen to be approximately equal to the fundamental frequency component of the square wave AC signals from the first and second inverter circuits 20, 21.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. An operating circuit for a gas discharge lamp with first and second lamp electrodes, said operating circuit comprising:

rectifier means connected to an AC power line for generating positive and negative DC voltages;

first inverter means connected to said rectifier means for converting said DC voltages into a first substantially square wave AC signal, said first inverter means including a first half-bridge transistor circuit;

first series resonance means connecting said first inverter means with the first lamp electrode to provide said first substantially square wave AC signal to the first lamp electrode;

a first firing circuit having a first charge-discharge circuit connected to said rectifier means;

a first trigger element including a first diac, said first trigger element interconnecting said first charge-discharge circuit and said first half-bridge transistor circuit;

second inverter means connected to said rectifier means for converting said DC voltages into a second substantially square wave AC signal, said second inverter means including a second half-bridge transistor circuit, said second inverter means being connected to the second lamp electrode to provide said second substantially square wave AC signal to the second lamp electrode, wherein said first and second substantially square wave AC signals have substantially equal fundamental frequencies and are out of phase;

a second firing circuit having a second charge-discharge circuit connected to said rectifier means; and a second trigger element including a second diac, said second trigger element interconnecting said second charge-discharge circuit and said second half-bridge transistor circuit.

2. The operating circuit as claimed in claim 1, wherein said first series resonance means has a resonant frequency approximately equal to said fundamental frequencies of said first and second substantially square wave AC signals.

3. The operating circuit as claimed in claim 1, further comprising second series resonance means connecting said second inverter means with the second lamp electrode to provide said second substantially square wave AC signal to the second lamp electrode.

4. The operating circuit as claimed in claim 3, wherein said first and second series resonance means have equal resonant frequencies which are equal to a harmonic component of said fundamental frequencies of said first and second substantially square wave AC signals.

5. The operating circuit as claimed in claim 1, wherein said first and second substantially square wave AC signals are approximately 180° out of phase.

* * * * *